US010727591B2

(12) United States Patent
Rogers

(10) Patent No.: US 10,727,591 B2
(45) Date of Patent: Jul. 28, 2020

(54) APPARATUSES AND METHODS FOR A PLANAR WAVEGUIDE ANTENNA

(71) Applicant: Honeywell International Inc., Morris Plains, NJ (US)

(72) Inventor: Shawn David Rogers, Johns Creek, GA (US)

(73) Assignee: Honeywell International Inc., Morris Plains, NJ (US)

( * ) Notice: Subject to any disclaimer, the term of this patent is extended or adjusted under 35 U.S.C. 154(b) by 183 days.

(21) Appl. No.: 16/055,700

(22) Filed: Aug. 6, 2018

(65) Prior Publication Data

US 2020/0044344 A1 Feb. 6, 2020

(51) Int. Cl.

| | |
|---|---|
| ***H01Q 5/42*** | (2015.01) |
| ***H01Q 21/00*** | (2006.01) |
| ***H01Q 21/24*** | (2006.01) |
| ***H01Q 25/00*** | (2006.01) |
| ***H01Q 9/04*** | (2006.01) |
| ***H01P 1/04*** | (2006.01) |

(52) U.S. Cl.

CPC ..... *H01Q 5/42* (2015.01); *H01P 1/042* (2013.01); *H01Q 9/0478* (2013.01); *H01Q 21/005* (2013.01); *H01Q 21/245* (2013.01); *H01Q 25/001* (2013.01)

(58) Field of Classification Search

CPC ..... H01Q 5/42; H01Q 21/005; H01Q 9/0478; H01Q 21/245; H01Q 25/001; H01P 1/042

See application file for complete search history.

(56) References Cited

U.S. PATENT DOCUMENTS

| | | | | |
|---|---|---|---|---|
| 4,959,658 | A | 9/1990 | Collins | |
| 5,394,163 | A * | 2/1995 | Bullen | H01Q 5/42 343/700 MS |
| 5,638,079 | A * | 6/1997 | Kastner | H01Q 21/005 343/768 |
| 5,905,472 | A * | 5/1999 | Wolfson | H01Q 21/005 342/81 |

(Continued)

OTHER PUBLICATIONS

Kim, Dong-yeon et.al., "Dual and Linearly Polarized SIW Series Slot Array Antenna for Ka Band", http://ap-s.ei.luat.ac.jpt/isapx/2011/pdf/[FrP1-21]%20A03_1006.pdf, Retrieved Mar. 27, 2018, pp. 1-4.

(Continued)

*Primary Examiner* — Hai V Tran
*Assistant Examiner* — Michael M Bouizza
(74) *Attorney, Agent, or Firm* — Fogg & Powers LLC

(57) ABSTRACT

An antenna comprises: a first set of two subarrays and a second set of two subarrays, where each subarray comprises: a set of antenna elements; a set of shunt waveguides, where each shunt waveguide is coupled to a unique subset of antenna elements; and a series waveguide coupled to each shunt waveguide of the set of shunt waveguides; wherein all of the series waveguides are substantially parallel; wherein each subarray of the first set is interleaved with a unique subarray of the second set so as to form first interleaved subarrays and second interleaved subarrays; wherein the first interleaved subarrays and the second interleaved subarrays are adjacent; and wherein the series waveguides of the second set are disposed within the series waveguides of the first set without any interceding series waveguides.

20 Claims, 12 Drawing Sheets

(56) References Cited

U.S. PATENT DOCUMENTS

| | | | |
|---|---|---|---|
| 6,028,562 | A | 2/2000 | Guler et al. |
| 5,086,304 | A | 7/2000 | Hujishima et al. |
| 6,127,985 | A | 10/2000 | Guler |
| 9,343,795 | B1 | 5/2016 | Halligan et al. |

OTHER PUBLICATIONS

Meng, Mingzia et al. "Design of Dual-Polarized Slotted Waveguide Array", "Antennas, Propatation and EM Theory", "2008 8th International Symposium on Antennas, Propatation and EM Theory, Nov. 2-5, 2008", pp. 271-273, Publisher: IEEE.

Ranzani, Leonardo et al, "G-Band Micro-Fabricated Frequency-Steered Arrays With 2/GHz Beam Steering", "IEEE Transactions on Terahertz Science and Technology", Dated Sep. 2013, pp. 566-573, vol. 3, No. 5, Publisher: IEEE.

Zhang, Miao et al, "Design of a Double-Layer Slotted Waveguide Array with a Partially Corporate Feed Circuit Installed in the Bottom Layer and its Fabrication by Diffusion Bonding of Laminated Thin Plates in 38 GHz Band", "The 2009 International Symposium on Antennas and Propatation, Oct. 20-23, 2009, Bangkok, Thailand", pp. 373-376.

* cited by examiner

APPARATUSES AND METHODS FOR A PLANAR WAVEGUIDE ANTENNA

BACKGROUND

A compact lightweight planar antenna using waveguide has been described for use in space limited applications such as aircraft and satellite communications. Such a planar antenna may be configured to operate with two different polarization states to provide polarization diversity to preclude the need for two physically separate antennas. U.S. Pat. No. 6,127,985 ('985 patent) describes such an antenna; the '985 patent is hereby incorporated by reference in its entirety.

However, the planar antenna disclosed in the '985 patent has limited bandwidth, is of rectangular shape, and has equal antenna element power levels (uniform amplitude distribution). It is well-known that the uniform amplitude distribution over the planar aperture leads to predictable but sometimes higher-than-desired antenna pattern sidelobe levels depending upon the intended application. There is a need for such a compact planar antenna with dual polarization states that has increased bandwidth, is not constrained to a rectangular boundary, and can have a tapered amplitude distribution which leads to reduced antenna pattern sidelobe levels.

SUMMARY

An antenna is provided. The antenna comprises: a first set of two subarrays, where each subarray of the first set of two subarrays comprises: a first set of antenna elements; a first set of shunt waveguides, where each shunt waveguide of the first set of shunt waveguides is coupled to a unique subset of the first set of antenna elements; and a first series waveguide coupled to each shunt waveguide of the first set of shunt waveguides; a second set of two subarrays, where each subarray of the first set of two subarrays comprises: a second set of antenna elements; a second set of shunt waveguides, where each shunt waveguide of the second set of shunt waveguides is coupled to a unique subset of the second set of antenna elements; and a second series waveguide coupled to each shunt waveguide of the second set of shunt waveguides; wherein all of the series waveguides are substantially parallel; wherein each subarray of the first set of subarrays is interleaved with a unique subarray of the second set of subarrays so as to form first interleaved subarrays and second interleaved subarrays; wherein the first interleaved subarrays and the second interleaved subarrays are adjacent; and wherein the second series waveguides, of the first interleaved subarrays and the second interleaved subarrays, are disposed within the first series waveguides, of the first interleaved subarrays and the second interleaved subarrays, without any interceding series waveguides.

DRAWINGS

Embodiments of the present invention can be more easily understood and further advantages and uses thereof more readily apparent, when considered in view of the description of the preferred embodiments and the following figures in which.

In accordance with common practice, the various described features are not drawn to scale but are drawn to emphasize features relevant to the present invention. Reference characters denote like elements throughout figures and text.

DETAILED DESCRIPTION

Figure 1:
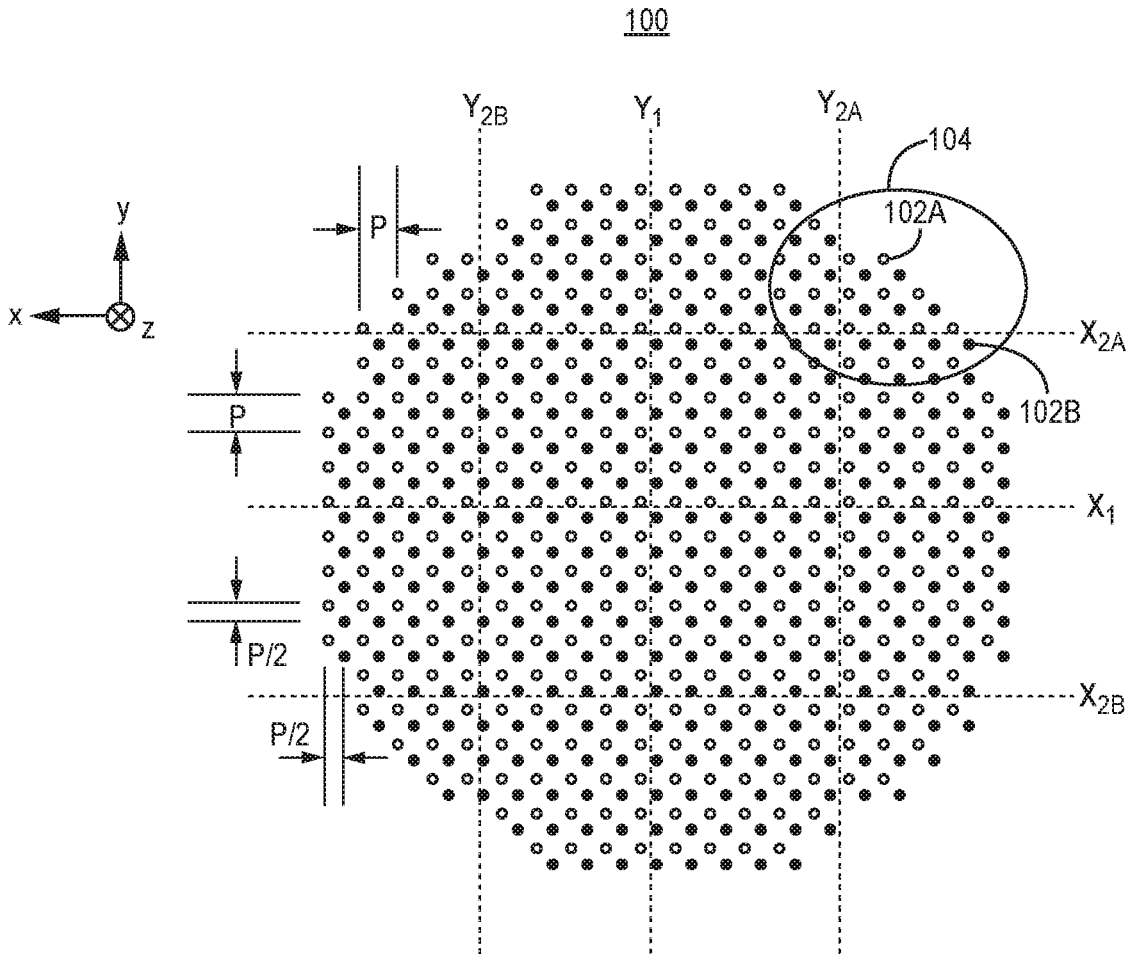
FIG. 1 illustrates a diagram of one embodiment of a first set of antenna elements and a second set of antenna elements on an external face of a planar antenna with subarrays.

In the following detailed description, reference is made to the accompanying drawings that form a part hereof, and in which is shown by way of specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the scope of the present invention. The following detailed description is, therefore, not to be taken in a limiting sense.

The embodiments of the invention described herein illustrate a planar antenna with a first set of antenna elements and a second set of antenna elements. An antenna element receives and transmits electromagnetic energy respectively from and to free space. The antenna element comprises an aperture, a slot, and/or a cavity. An exemplary antenna element is described in the '985 patent.

The second set of antenna elements is interleaved with the first set of antenna elements by offsetting the location of each antenna element of the second set from an adjacent antenna element of the first set by, e.g. half a period in each of the X and Y axes. The period is an average of distances between adjacent antenna elements of a set. Optionally, each set of antenna elements is configured to radiate electromagnetic energy having different polarizations, e.g. orthogonal polarizations such as orthogonal linear polarizations.

Bandwidth of a planar antenna can be increased by minimizing the number of antenna elements per subarray.

This can be achieved by implementing the planar antenna with at least two subarrays for each set of antenna elements. For purposes of clarity, the planar antenna would have at least two subarrays for the first set of antenna elements, and at least two subarrays for the second set of antenna elements. Such an antenna is hereinafter referred to as a planar antenna having at least two subarrays for each set of antenna elements or a planar antenna with subarrays. Because each subarray has fewer antenna elements, more subarrays are typically required to form the planar antenna. Each subarray comprises a unique feed network coupled to a set of antenna elements.

Each feed network comprises a unique set of shunt waveguides coupled to a series waveguide. The shunt waveguides are coupled to a corresponding set of antenna elements. Optionally, electromagnetic energy may be coupled by a power divider (or primary power divider) to the subarrays. The primary power divider comprises one or more fundamental two way power dividers, e.g. being a two way, four way, eight way, etc. power divider. The subarrays coupled to a fundamental two way power divider are adjacent in one axis, e.g. the x axis. For pedagogical reasons, primary power dividers, specifically four way primary power dividers, are subsequently illustrated. However, in the alternative, signals may be fed to subarrays directly, and without the use of power dividers.

The primary power dividers may be fed independently or by other power divider(s) depending upon the complexity of the planar antenna. The other power divider(s) may or may not be part of the planar antenna with subarrays; that is that any other power divider may or may not be formed in a planar fashion and integrated with the planar antenna.

Another benefit of reducing the number of antenna elements fed by the feed network is that the sidelobe level of the planar antenna with subarrays can be decreased with proper design in comparison to other planar antennas, e.g. as illustrated in the '985 patent. Reduced sidelobe level means reduced radiated power in sidelobes compared to radiated power in the main beam. The sidelobes are reduced by constraining the distribution of power levels in the elements to be a tapered amplitude distribution over the face of the planar aperture. Having multiple subarrays with a reduced number of antenna elements in each subarray allows for a greater range of antenna element power levels to be realized which enables the desired amplitude taper to be achieved.

FIG. 1 illustrates a diagram of one embodiment of a first set of antenna elements and a second set of antenna elements on an external face of a planar antenna with subarrays 100. The shape of the external face of the planar antenna is circular; however it may be another shape such as rectangular (as shown in the '985 patent) or square. The two sets of antenna elements correspond to two type of electromagnetic energy, e.g. in the microwave and/or millimeter wave spectra. The two types of electromagnetic energy may differ by at least one parameter, e.g. frequency and/or polarization. For pedagogical purposes, the parameter illustrated herein is polarization, and each set of antenna elements will operate in the same frequency spectrum.

The first set of antenna elements corresponds to a first polarization state. The second set of antenna elements corresponds to a second polarization state. For example, the first set of antenna elements is configured to at least one of: transmit a first electromagnetic signal having a first polarization state and receive the first electromagnetic signal having the first polarization state; and the second set of antenna elements is configured to at least one of: transmit a second electromagnetic signal having a second polarization state and receive the second electromagnetic signal having the second polarization state. For example, each polarization state may be a linear polarization where the first and second polarization states are respectively slant left and slant right linear polarizations.

Antenna element 102A is a representative antenna element of the first set. Antenna element 102B is a representative antenna element of the second set. These antenna elements are located in an interleaved subarray 104. The antenna elements of each set are separated from adjacent elements of the same set by one period (P). The antenna elements of one set are separated from adjacent elements the other set by half of a period (P/2) in each of the X and Y axes. The period is one half of a guide wavelength in a shunt waveguide for the corresponding set of antenna elements at substantially the center frequency of an operating bandwidth for a corresponding set of antenna elements. Optionally, a subarray of the first set and a subarray of the second set, which are interleaved, each have a substantially equal number of antenna elements of the first set and the second set; alternatively, the number of antenna elements may be substantially unequal.

For example, the planar antenna with subarrays illustrated in FIG. 1 can be implemented with:

a. four subarrays by dividing the antenna elements of the first set and second set by lines $X_1$, and $Y_1$; or b. sixteen subarrays by dividing the antenna elements of the first set and second set by lines $X_1$, $X_{2A}$, $X_{2B}$, $Y_1$, $Y_{2A}$ and $Y_{2B}$.

The planar antenna with subarrays is scalable, and, e.g., can be divided into more than sixteen subarrays such as thirty two subarrays, sixty four subarrays, etc. Further, the lines $X_1$, $X_{2A}$, $X_{2B}$, $Y_1$, $Y_{2A}$, and $Y_{2B}$ are for illustration purposes only.

Figure 2:
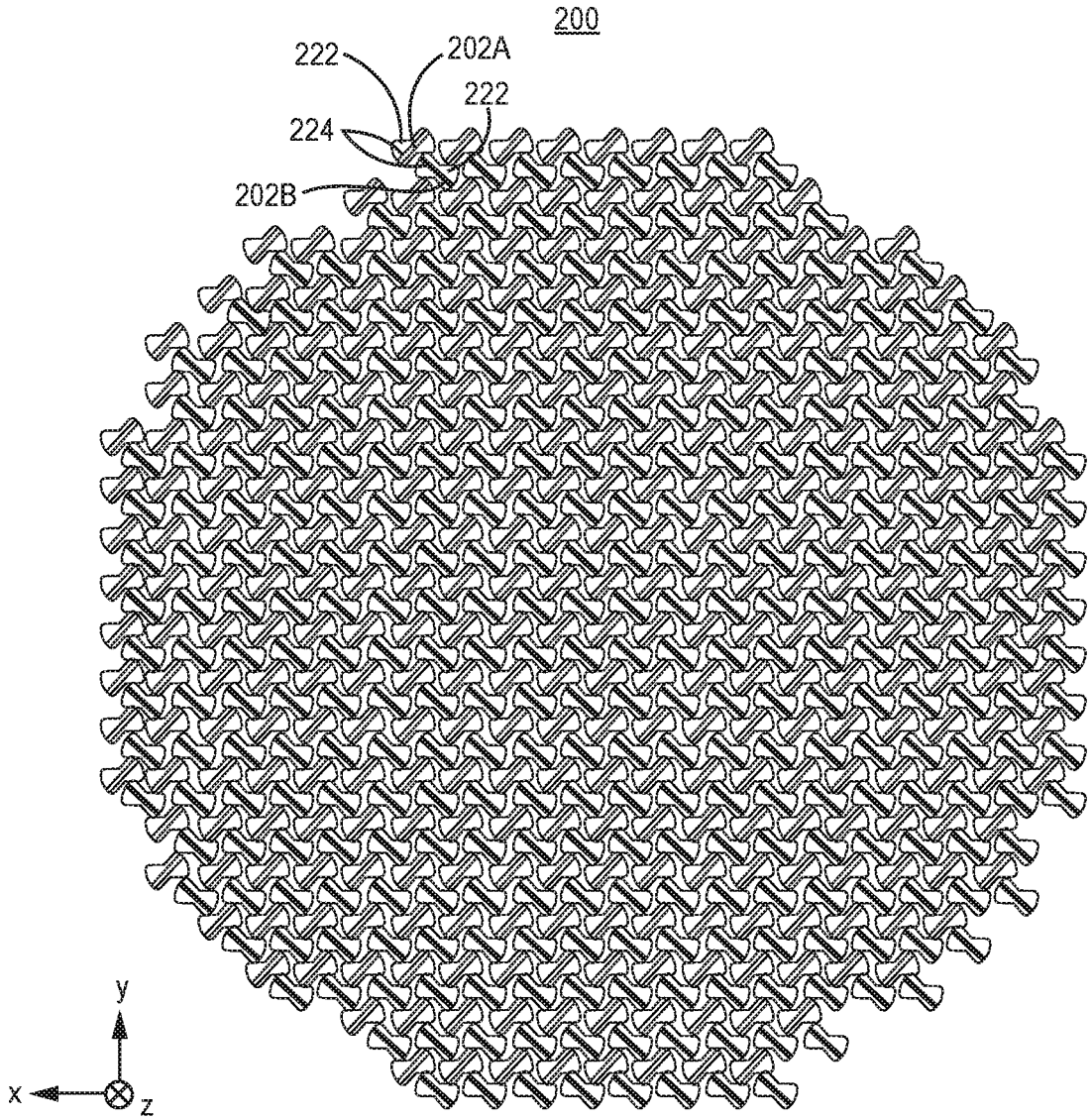
FIG. 2 illustrates a diagram of one embodiment of a plate with antenna elements.

Optionally, the antenna elements may be formed with plates. FIG. 2 illustrates a diagram of one embodiment of a plate with antenna elements 200. The plate 200 is formed from conductive material, such as metal. Thus, such a plate may also be referred to as a conductive plate. Optionally, the illustrated plate 200 is formed over another plate, e.g. which forms part of the feed network for the antenna elements such as a part of a waveguide; the other plate has apertures to transmit and/or receive electromagnetic energy from the antenna elements 200. A plate implementing a different feed network that differs from the present invention is illustrated in the '985 patent. All or some of the waveguides of the feed network can be implemented with plates, e.g. conductive plates and/or non-conductive plates, that have an area substantially equivalent to the area of the plate with antenna elements. Such plates are attached to one another as illustrated in the '985 patent. Alternatively, all or some of the waveguides can be implemented with discrete waveguides not implemented with such plate(s); such discrete waveguides have at least one sidewall not implemented with a plate.

Optionally, each antenna element, e.g. antenna elements 202A, 202B, comprises a cavity 222 and a radiating slot 224. Optionally, to implement dual polarization, each cavity 222 has a bow-tie shape. The shape of the cavity, however, may be a different shape such as oval. The radiating slot 224 of an antenna element 202A of the first set is rotated ninety degrees with respect to the radiating slot 224 of an adjacent antenna element 202B of the second set. The design of such antenna elements is further described in the '985 patent. Other types of antenna elements may be used, e.g. if the two sets differ by another type of parameter such as for example frequency.

Figure 3:
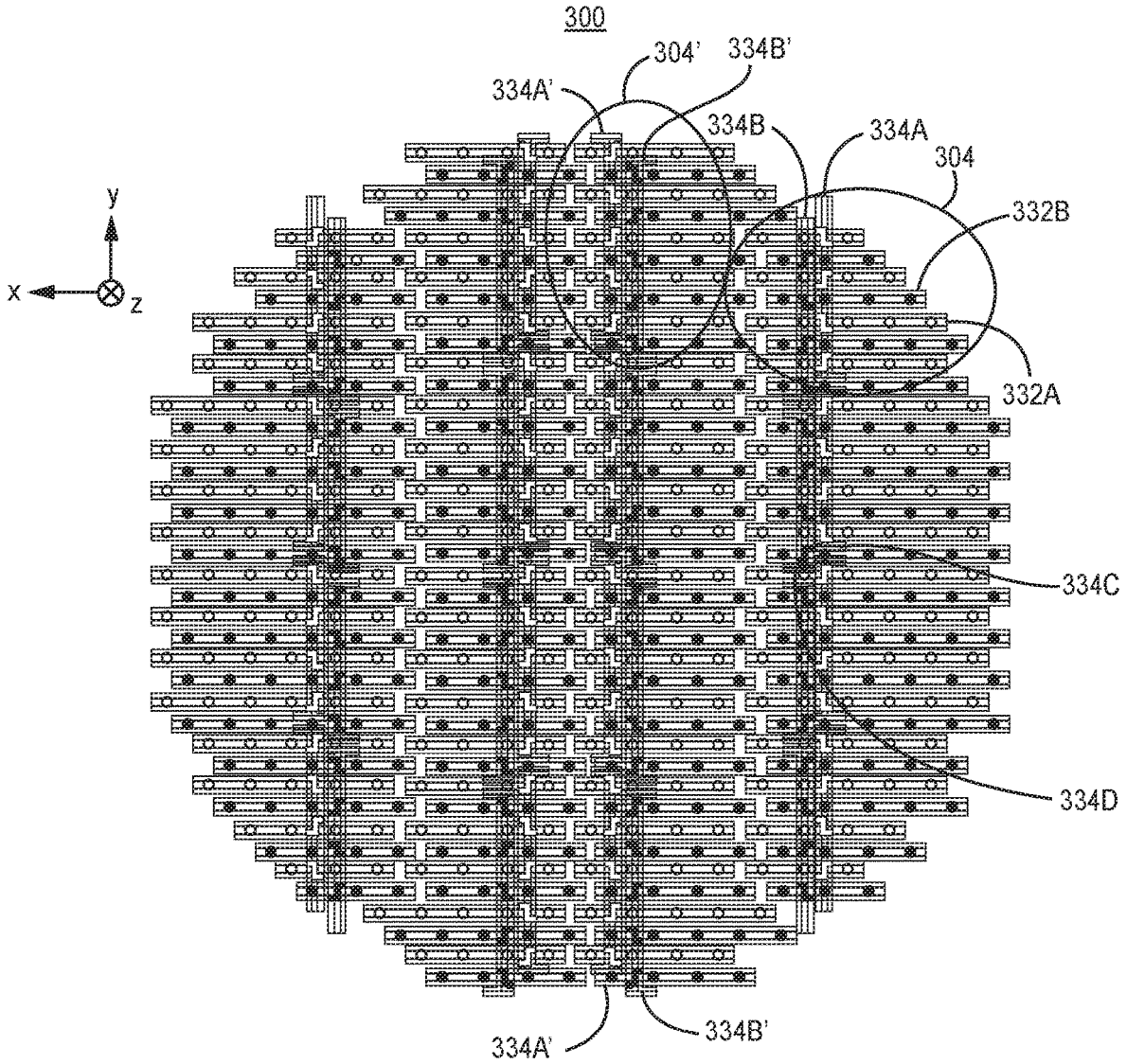
FIG. 3 illustrates a diagram of one embodiment of a first set of antenna elements and a second set of antenna elements, shunt waveguides, and series waveguides of a planar antenna with subarrays.

For pedagogical reasons, the implementation of the planar antenna with subarrays 100 will be illustrated with sixteen subarrays. FIG. 3 illustrates a diagram of one embodiment of a first set of antenna elements and a second set of antenna elements, shunt waveguides, and series waveguides of a planar antenna with subarrays 300. The illustrated planar antenna with subarrays 300 includes first interleaved subarrays 304 and second interleaved subarrays 304'. Interleaved subarrays comprise a subarray for the first set and a subarray for the second set, where each of the antenna elements of the first set and the second set are interleaved.

For each of the interleaved subarrays, each antenna element of a set in a line parallel to the X-axis is coupled to a corresponding shunt waveguide for that set. For example, the first interleaved subarrays 304 comprises a shunt waveguide 332A coupled to antenna elements of the first set, and another shunt waveguide 332B coupled to antenna elements of the second set. The shunt waveguides coupled to antenna elements of the first set in the subarray 304 are coupled by a series waveguide 334A. The shunt waveguide of the second set in the subarray 304 are coupled by another series waveguide 334B. For each set of antenna elements in interleaved subarrays of the planar antenna with subarrays 300, two or more shunt waveguides are coupled by one series waveguide.

When the first interleaved subarrays and the second interleaved subarrays are adjacent, e.g. in the X axis, the series waveguides coupled to the first set and the second set of both of the first interleaved subarrays and second interleaved subarrays are substantially parallel. As illustrated in FIG. 3, the second series waveguides 334B, 334B' are disposed within the first series waveguides 334A, 334A' without any interceding series waveguides. The first interleaved subarrays and the second interleaved subarrays are respectively coupled by two fundamental two way power dividers.

As discussed in the '985 patent, the shunt and series waveguides may optionally be implemented by ridge waveguides. The ridge waveguides described herein may be "T" ridge waveguides as described in the '985 patent or may have ridges with cross sections having the conventional rectangular shape or other non-conventional shapes. As an alternative to ridge waveguides, dielectric-filled rectangular waveguides and/or substrate integrated waveguides may be used. Also, air or vacuum filled rectangular waveguides can be used as an alternative for the series waveguides; if air or vacuum filled rectangular waveguides are used as series waveguides, the subsequently described series slots, such as Z slots, are on edge walls.

Figure 4:
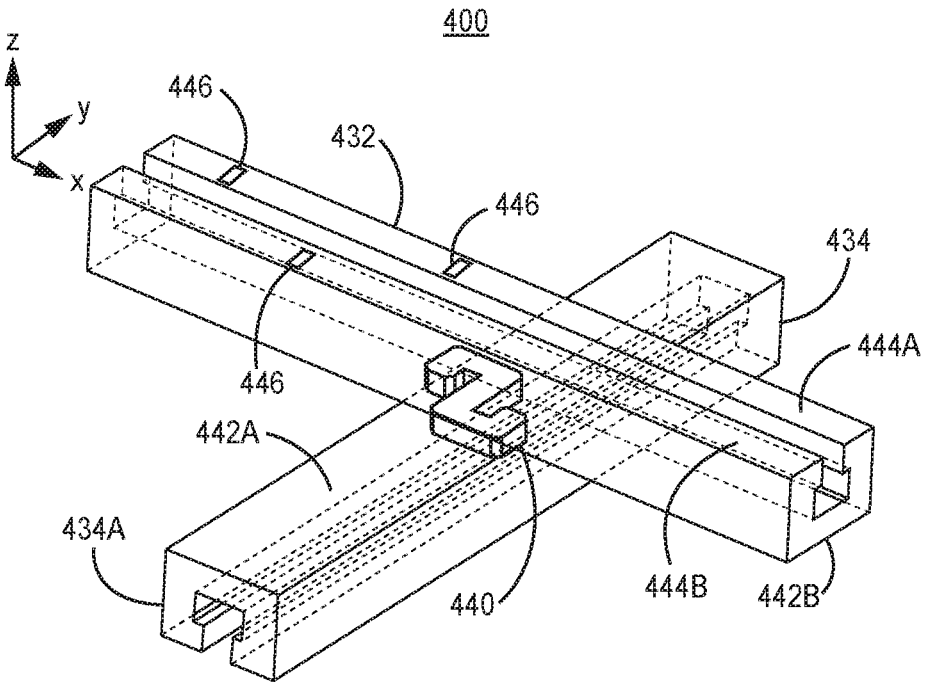
FIG. 4 illustrates a diagram of one embodiment of a shunt waveguide coupled to a series waveguide with a Z-slot aperture.

Electromagnetic energy is coupled from a shunt waveguide to a series waveguide, and visa versa, through a series slot in and between the shunt and series waveguides. A series slot that is a Z-slot is illustrated for pedagogical purposes; however series slots of other shapes, e.g. rectangular or circular, can be used. FIG. 4 illustrates a diagram of one embodiment of a shunt waveguide coupled to a series waveguide with a series slot shown as a Z-slot 400. The series waveguide 434 couples electromagnetic energy to the shunt waveguide 432 through a Z-slot 440. The Z-slot 440 is formed by Z-shaped openings in the broadwall 442A of the series waveguide 434 and the broadwall 442B of the shunt waveguide 432 where those broadwalls 442A, 442B overlap. As discussed above, the series waveguides 434 and shunt waveguides 432 each can be made either from conductive plates or discrete waveguides, e.g., attached to one another.

Bifurcated broadwalls 444A, 444B form portions of a broadwall opposite another broadwall 442B of a ridged waveguide. The bifurcated broadwalls 444A, 444B of the shunt waveguide 432 have shunt slots 446 in the bifurcated broadwalls 444A, 444B that periodically alternate from a first bifurcated broadwall 444A to a second bifurcated broadwall 444B. The illustrated shunt slots 446 are rectangular for pedagogical reasons. However, the shunt slots 446 can be another shape, such as circular. Alternatively, the shunt slots 446 can be on a single bifurcated broadwall. The shunt slots 446 are aligned with cavities 222 of an antenna element corresponding to the same set.

At least one end of a series waveguide of the illustrated embodiments may be terminated by a short, e.g. a conductor covering a corresponding end. At least one end of a shunt waveguide of the illustrated embodiments may be terminated by a short, e.g. a conductor covering a corresponding end. If so, typically, the short will be displaced from a nearest antenna element by substantially a quarter guide wavelength in a shunt waveguide; the short will be displaced from the nearest series slot by substantially a half guide wavelength in a series waveguide.

Figure 5:
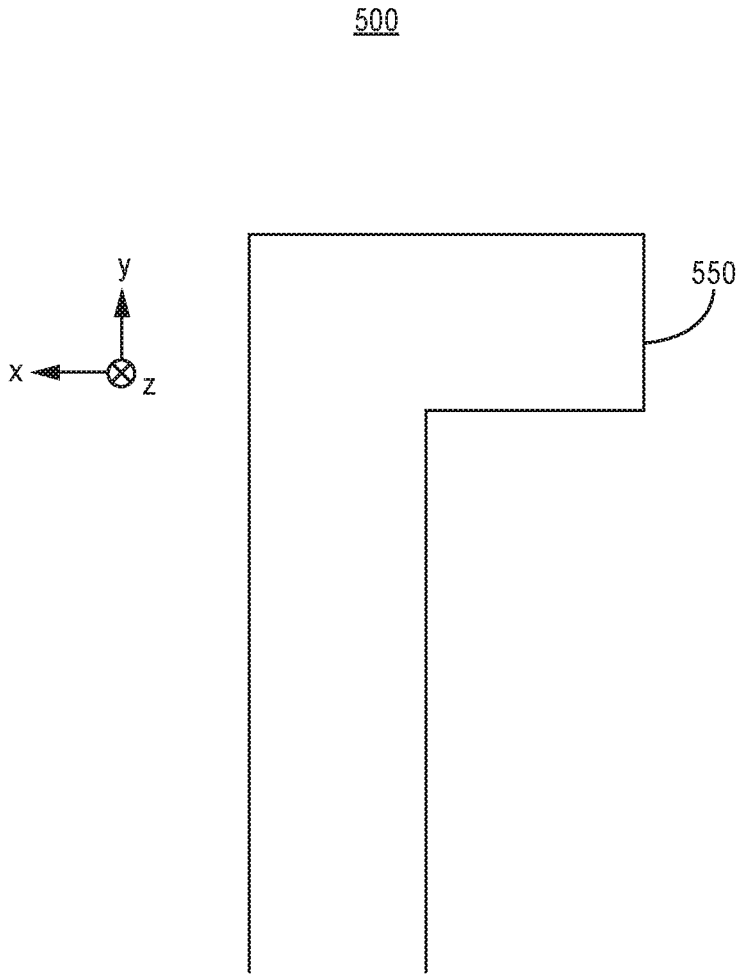
FIG. 5 illustrates a plan view of embodiment of a bent termination of a series waveguide.

FIG. 5 illustrates one embodiment of a plan view of a bent termination of a series waveguide 500. The series waveguides are terminated at each end by a short 550, e.g. using a conductor. For proper operation, the short must be displaced from the center of the closest series slot 440 by substantially one half of a guide wavelength as described above. Optionally, the half of a guide wavelength is the one half of a wavelength at the center frequency of the operating band of the planar antenna with subarrays.

Normally, it would be desirable to use an unbent termination for a series waveguide. This can be done at the edges of the planar antenna with subarrays. However, where the ends of two series waveguides are adjacent, there may not be sufficient room to do so without bending, e.g. at ninety degrees, the waveguide prior to terminating it with a short. Returning to FIG. 3, this allows series waveguides corresponding to the same set to be placed in line with, e.g. stacked upon, one another as shown for series waveguide 334A and 334C for the first set, and 334B and 334D for the second set.

Electromagnetic energy must be divided between subarrays and coupled into series waveguides of the subarrays. Electromagnetic energy must also be coupled out of the series waveguides and combined. A primary power divider may be used to perform such power combining and division. For pedagogical purposes, the power divider is a four way power divider; however other power dividers, e.g. two way, eight way, or sixteen way power dividers may be used. The primary power divider may be optionally referred to as a primary power combiner. The primary power dividers described herein can be implemented with one or more conductive plates or otherwise implemented with separate waveguide networks.

Figure 6:
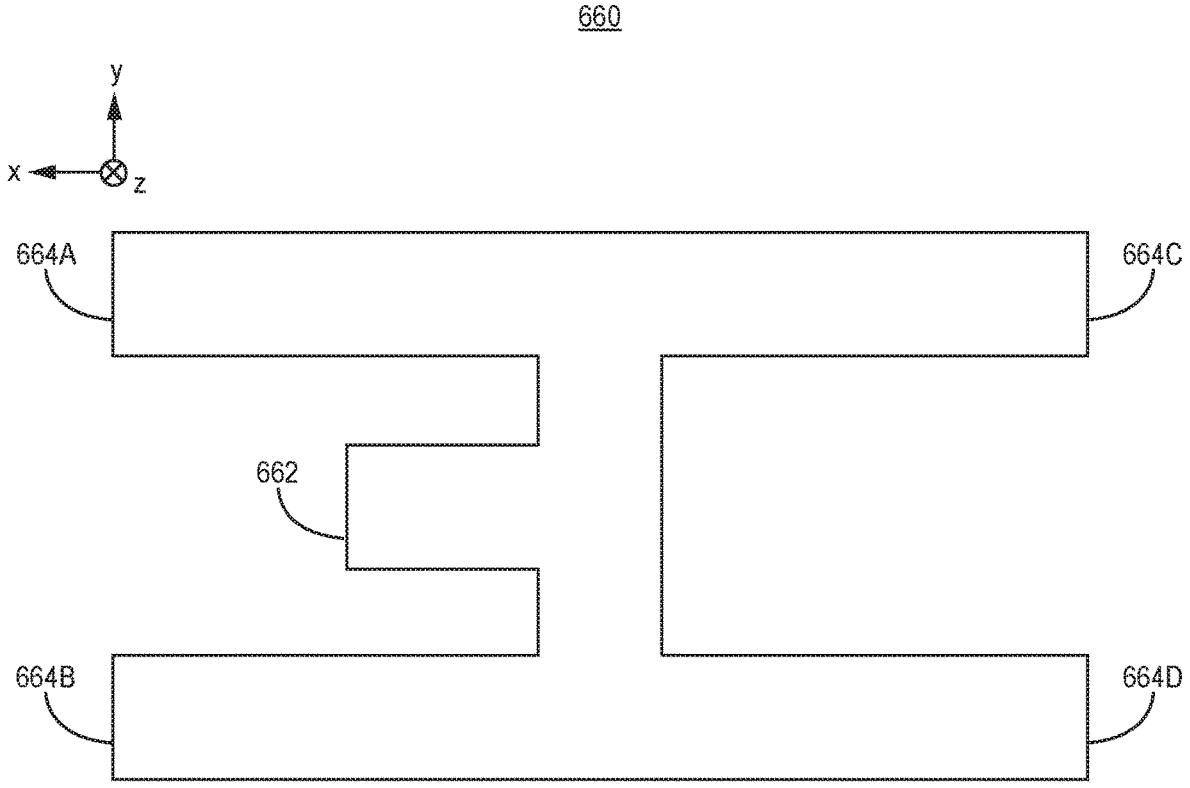
FIG. 6 illustrates a plan view of one embodiment of a four way power divider.

FIG. 6 illustrates a plan view of one embodiment of a four way primary power divider (four way power divider) 660. Optionally, the four way primary power divider 660 is implemented with H-plane rectangular waveguide which allows the four way primary power divider 660 to be relatively small in the Z axis (or depth or thickness) of the planar antenna with subarrays. However, alternatively, the four way primary power divider 660 can be implemented with another type of waveguide, e.g. E-plane rectangular waveguide. The four way primary power divider 660 includes a common port 662, a first port 664A, a second port 664B, a third port 664C, and a fourth port 664D. Electromagnetic energy provided to the common port is distributed to each of the first port 664A, the second port 664B, the third port 664C, and the fourth port 664D. A common port is the port from which electromagnetic energy is distributed from the other ports of the primary power divider and/or the port that distributes electromagnetic energy to the other ports of the primary power divider. The other ports of the primary power divider may be referred to as non-common ports. Thus for example, electromagnetic energy received by each of the first port 664A, the second port 664B, the third port 664C, and the fourth port 664D is combined and emitted from the common port 662; alternatively, electromagnetic energy received by the common port 662 is divided and distributed to each of the first port 664A, the second port 664B, the third port 664C, and the fourth port 664D. The power distribution of the primary power divider 660 depends upon the amount of power required in each subarray to achieve the ultimate tapered distribution of power in the elements for the overall planar waveguide antenna. This tapered distribution determines the sidelobe level for the planar waveguide antenna.

Figure 7:
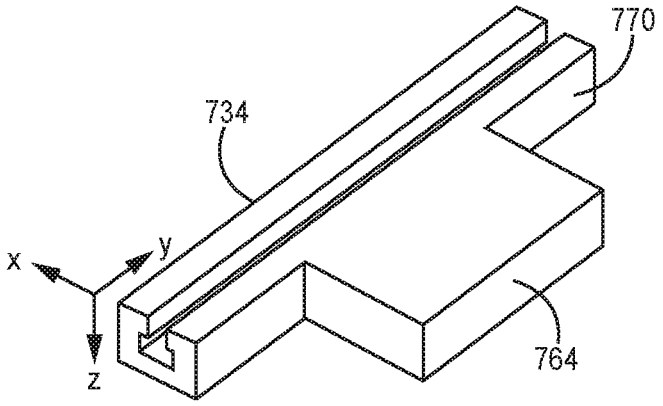
FIG. 7 illustrates a diagram of one embodiment of a connection between a series waveguide and a non-common port of a four way combiner.

FIG. 7 illustrates a diagram of one embodiment of a series waveguide coupled to a non-common port of a four way primary power divider 700. The non-common port 764 is coupled to the narrow wall 770 of the ridged waveguide that is a series waveguide 734.

Figure 8:
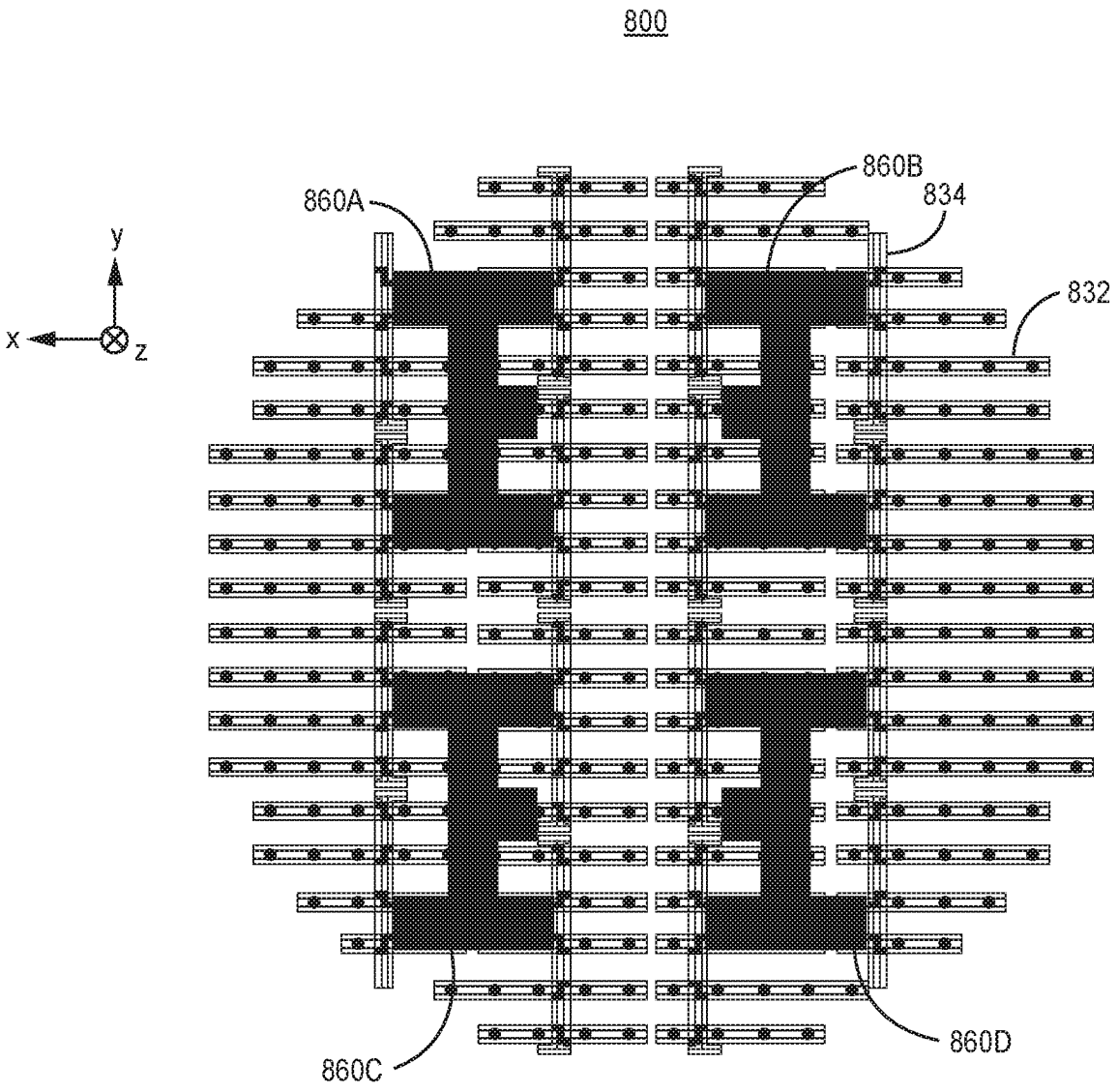
FIG. 8 illustrates a diagram of one embodiment of a distribution network for only a second set of antenna elements of a planar antenna with subarrays.

FIG. 8 illustrates a diagram of one embodiment of a distribution network for only a second set of antenna elements of a planar antenna with subarrays (second set distribution network) 800. The second set distribution network 800 includes a first four way primary power divider 860A, a second four way primary power divider 860B, a third four way primary power divider 860C, and a fourth four way primary power divider 860D. Each of such four way primary power dividers is coupled to four series waveguides 834, where each series waveguide corresponds to a unique subarray. Each series waveguide 834 in a subarray is coupled to a unique set of shunt waveguides 832. Each shunt waveguide in a subarray is coupled to a unique set of antenna elements in the subarray.

Figure 9:
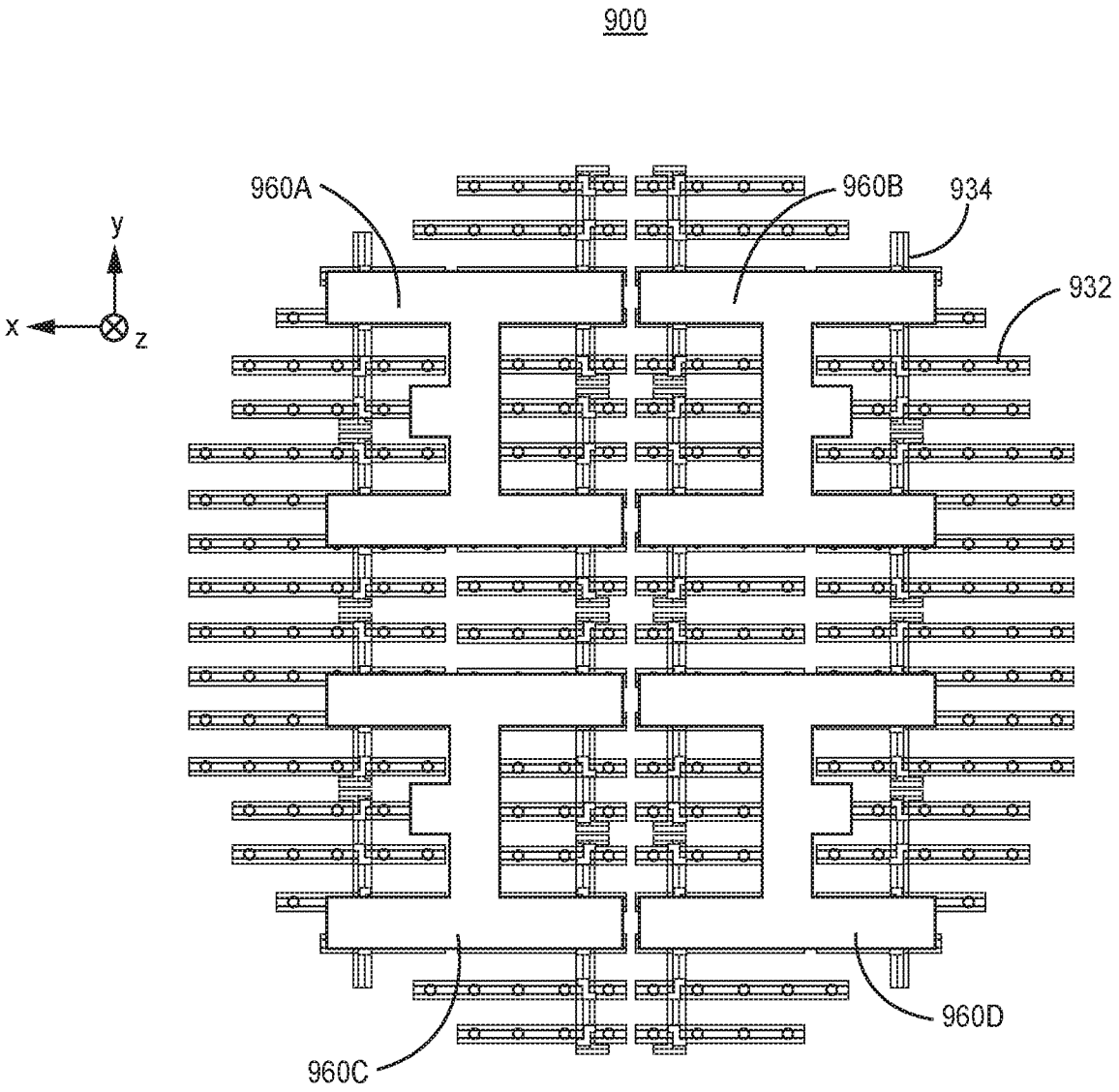
FIG. 9 illustrates a diagram of one embodiment of a distribution network for only a first set of antenna elements of a planar antenna with subarrays.

FIG. 9 illustrates a diagram of one embodiment of a distribution network for only a first set of antenna elements of a planar antenna with subarrays (first set distribution network) 900. The first set distribution network 900 includes a first primary power divider 960A, a second primary power divider 960B, a third primary power divider 960C, and a fourth primary power divider 960D. Each of such four way primary power dividers is coupled to four series waveguides 934, where each series waveguide corresponds to a unique subarray. Each series waveguide 934 in a subarray is coupled to a unique set of shunt waveguides 932. Each shunt waveguide in a subarray is coupled to a unique set of antenna elements in the subarray.

Further, the four way primary power dividers in the first set distribution network 900 are displaced in the Z axis from the four way primary power dividers in the second distribution network 800. Thus, as subsequently illustrated, each primary power divider of the first set distribution network 900 can be placed over a corresponding primary power divider of the second set distribution network 800. As a result, the waveguides of non-common ports of the first set distribution network 900 include two ninety degree bends so that each can be coupled to a narrow wall that is not adjacent to a narrow wall of a series waveguide 834 in the second set distribution network 800. Each non-common port of a four way power divider of the first set distribution network 900 and the second set distribution network 800 is coupled to the narrow wall in the manner illustrated in FIG. 7.

Figure 10:
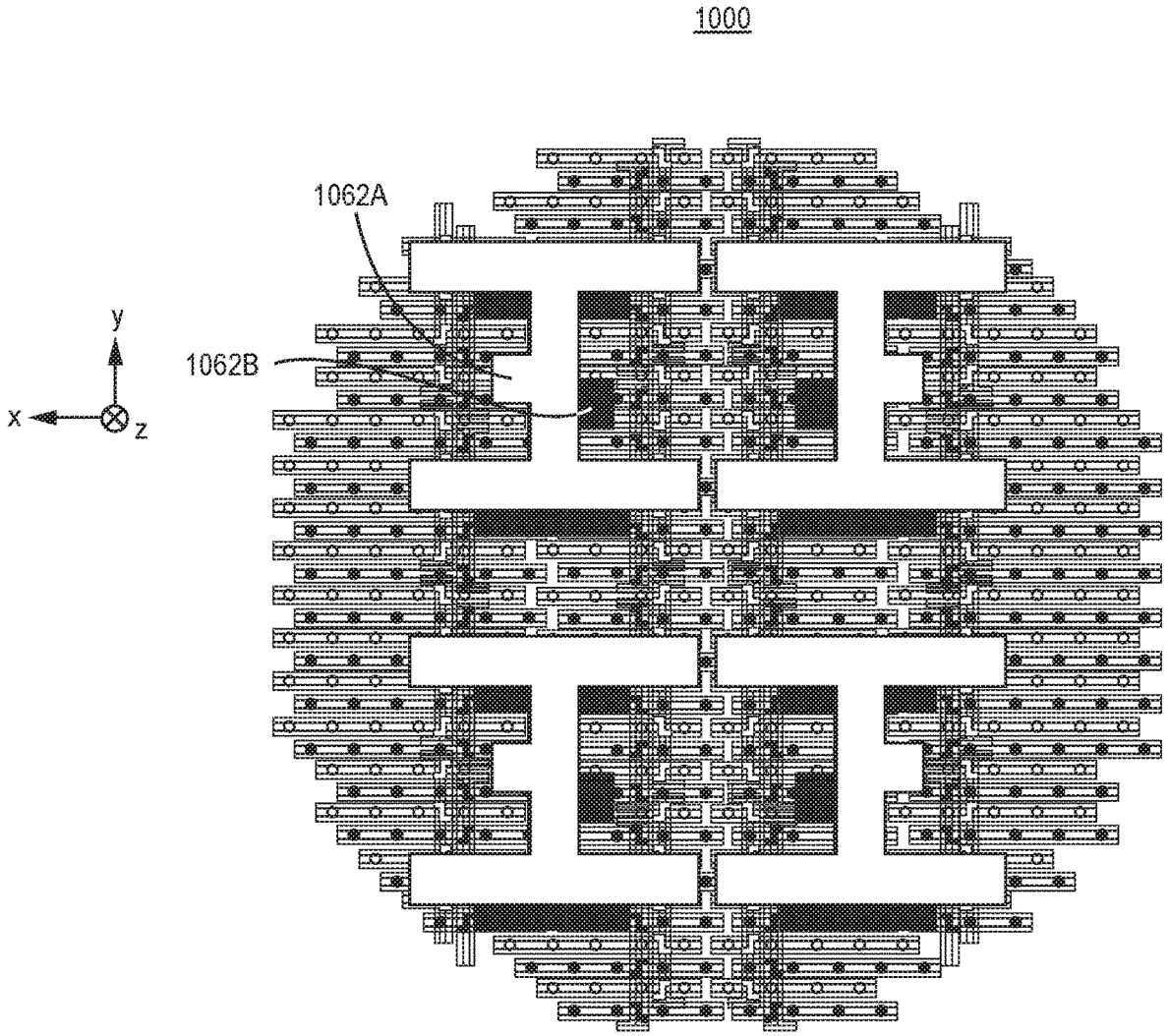
FIG. 10 illustrates a diagram of one embodiment of distribution networks for each of a first set of antenna elements and a second set of antenna elements of a planar antenna with subarrays.

FIG. 10 illustrates a diagram of one embodiment of distribution networks for each of a first set of antenna elements and a second set of antenna elements of a planar antenna with subarrays (distribution networks) 1000. The input/output (I/O) for a set of four interleaved subarrays is respectively a first common port 1062A and a second common port 1062B. FIG. 10 also illustrates second primary power dividers coupled to series waveguides (coupled to the second set of antenna elements) of a unique set of subarrays. Also shown are first primary power dividers coupled to series waveguides (coupled to the first set of antenna elements) of a unique set of subarrays. Each first primary power divider is mounted over a corresponding second primary power divider.

Figure 11:
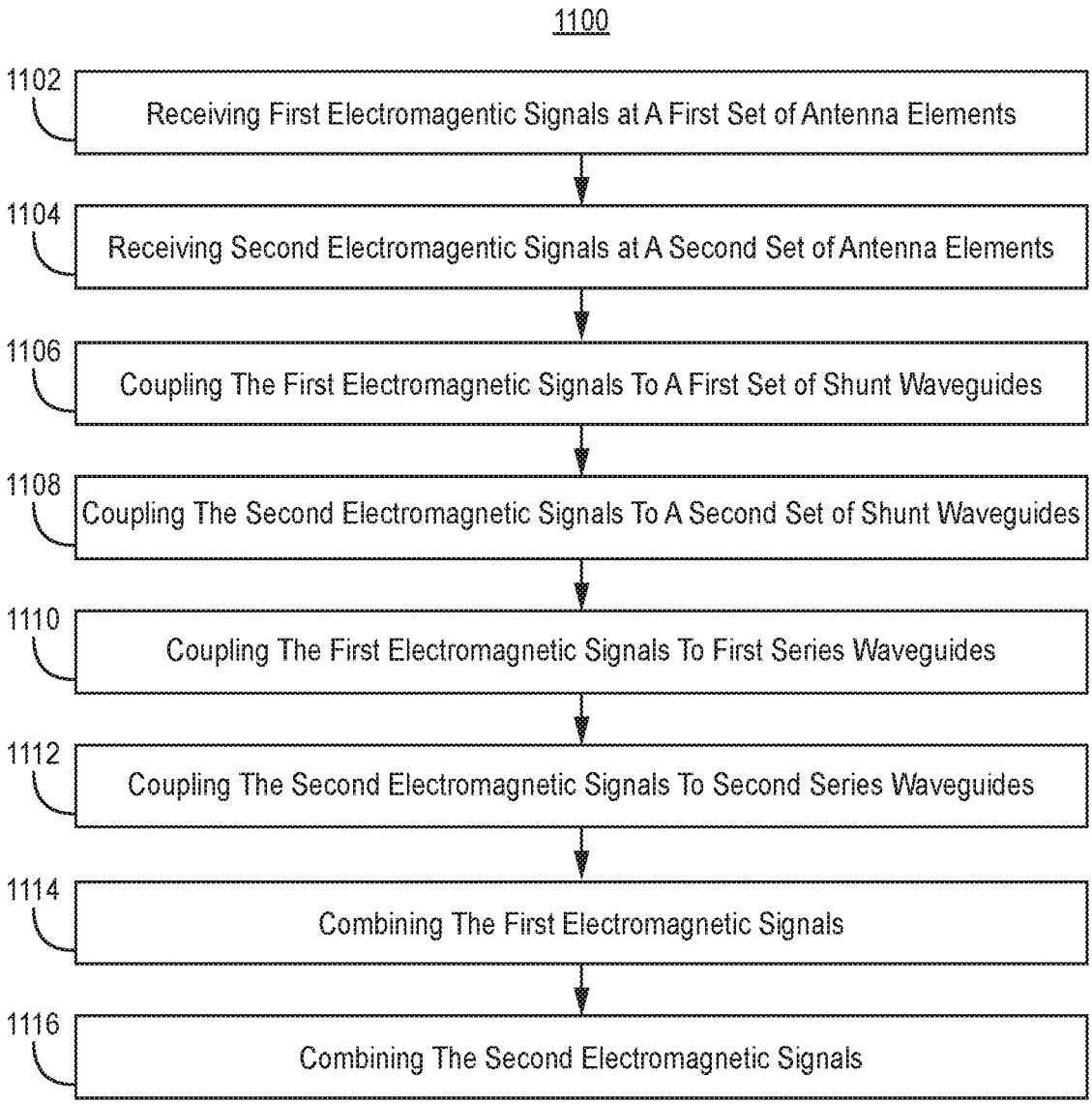
FIG. 11 illustrates an exemplary method of receiving electromagnetic signals with a planar antenna with subarrays.

FIG. 11 illustrates an exemplary method 1100 of receiving electromagnetic signals with a planar antenna with subarrays. To the extent the method 1100 shown in FIG. 11 is described herein as being implemented in the system shown in FIGS. 1-10, it is to be understood that other embodiments can be implemented in other ways. The blocks of the flow diagrams have been arranged in a generally sequential manner for ease of explanation; however, it is to be understood that this arrangement is merely exemplary, and it should be recognized that the processing associated with the methods (and the blocks shown in the Figures) can occur in a different order (for example, where at least some of the processing associated with the blocks is performed in parallel and/or in an event-driven manner).

In block 1102, receive first electromagnetic signals at a first set of antenna elements of each of two first subarrays of a planar antenna. In block 1104, receive second electromagnetic signals at a second set of antenna elements of each of two second subarrays of a planar antenna, where each first subarray coupled to the first set is interleaved with a unique second subarray creating a first interleaved subarray and a second interleaved subarray and where first interleaved subarrays and second interleaved subarrays are adjacent.

In block 1106, couple the first electromagnetic signals from the first set of antenna elements of each first subarray to a first set of shunt waveguides of the corresponding first subarray. In block 1108, couple the second electromagnetic signals from the second set of antenna elements of each second subarray to a second set of shunt waveguides of the corresponding second subarray.

In block 1110, couple the first electromagnetic signals from the first set of shunt waveguides of each first subarray to a first series waveguide of the corresponding first subarray. In block 1112, couple the second electromagnetic signals from the second set of shunt waveguides of each second subarray to a second series waveguide of the corresponding second subarray, where:

(a) all of the series waveguides are substantially parallel; and (b) the second series waveguides are disposed between the first series waveguides without any interceding series waveguides.

In block 1114, combine the first electromagnetic signals received from first series waveguides of the two different subarrays. In block 1116, combine the second electromagnetic signal received from second series waveguides of the two different subarrays. The first electromagnetic signals may be combined equally or unequally. The second electromagnetic signals may be combined equally or unequally.

Figure 12:
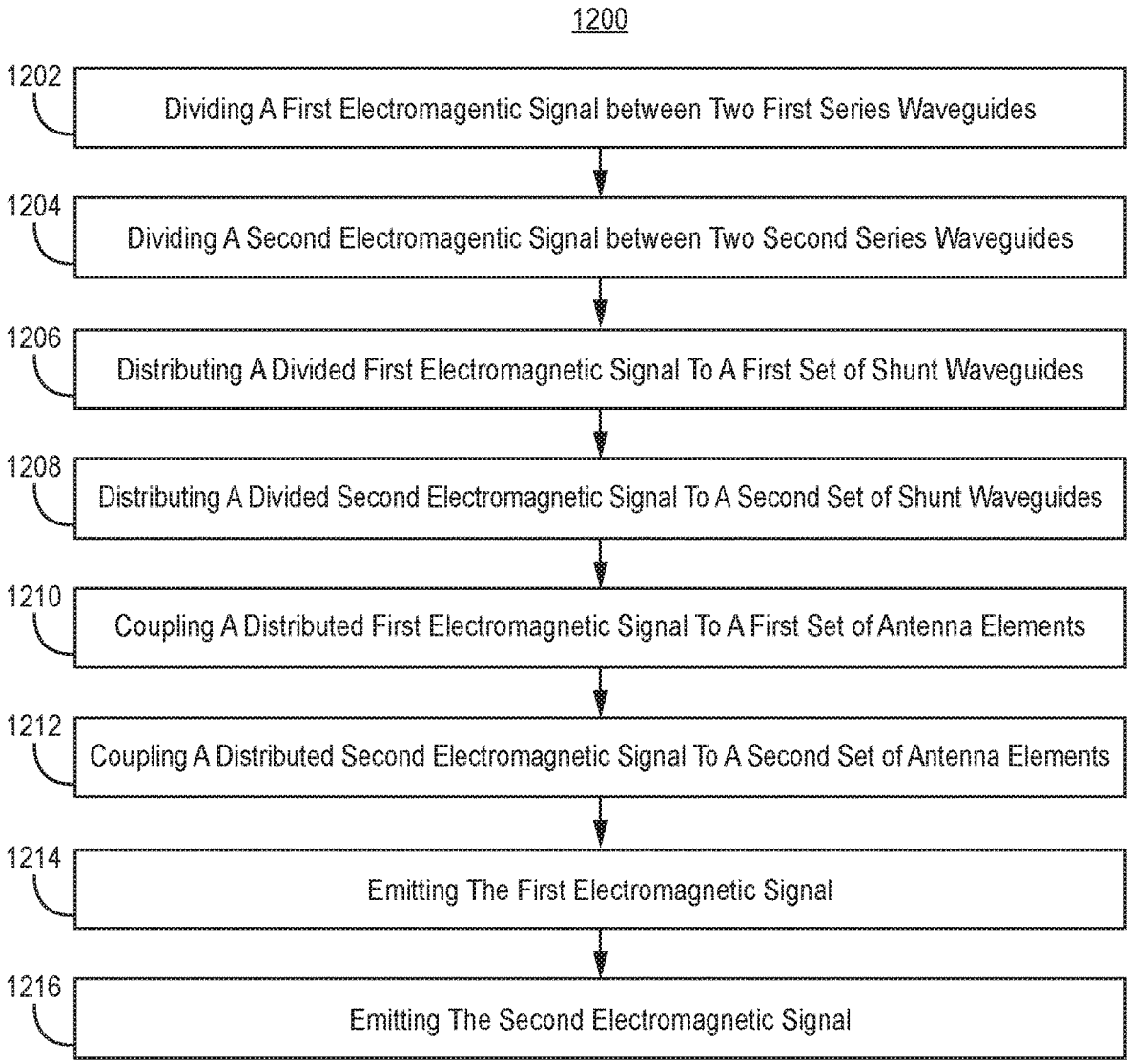
FIG. 12 illustrates an exemplary method 1200 of transmitting electromagnetic signals with a planar antenna with subarrays.

FIG. 12 illustrates an exemplary method 1200 of transmitting electromagnetic signals with a planar antenna with subarrays. To the extent the method 1200 shown in FIG. 12 is described herein as being implemented in the system shown in FIGS. 1-10, it is to be understood that other embodiments can be implemented in other ways. The blocks of the flow diagrams have been arranged in a generally sequential manner for ease of explanation; however, it is to be understood that this arrangement is merely exemplary, and it should be recognized that the processing associated with the methods (and the blocks shown in the Figures) can occur in a different order (for example, where at least some of the processing associated with the blocks is performed in parallel and/or in an event-driven manner).

In block 1202, divide a first electromagnetic signal between two first series waveguides, where each first series waveguide corresponds to a different subarray of a planar antenna. In block 1204, divide a second electromagnetic signal between two second series waveguides, where each second series waveguide corresponds to a different subarray of the planar antenna, where:

(a) all of the series waveguides are substantially parallel; and (b) the second series waveguides are disposed between the first series waveguides without any interceding series waveguides.

The first electromagnetic signals may be divided equally or unequally. The second electromagnetic signal may be divided equally or unequally.

In block 1206, distribute a divided first electromagnetic signal from each first series waveguide to a first set of shunt waveguides of a corresponding first subarray of two first subarrays. In block 1208, distribute a divided second electromagnetic signal from each second series waveguide to a second set of shunt waveguides of a corresponding second subarray of two second subarrays.

In block 1210 couple a distributed first electromagnetic signal from a first set of shunt waveguides to a first set of antenna elements of a corresponding first subarray of the two first subarrays, where a unique subset of the first set of the antenna elements is uniquely coupled to each shunt waveguide of the first set of shunt waveguides. In block 1212, couple a distributed second electromagnetic signal from a second set of shunt waveguides to a second set of antenna elements of a corresponding second subarray of the two second subarrays, where a unique subset of the second set of the antenna elements is uniquely coupled to each shunt waveguide of the second set of shunt waveguides, where each first subarray is interleaved with a unique second subarray creating a first interleaved subarray and a second interleaved subarray, and where first interleaved subarrays and second interleaved subarrays are adjacent.

In block 1214, emit the first electromagnetic signal from the first antenna elements. In block 1216, emit the second electromagnetic signal from the second antenna elements.

Advantageously, embodiments of the present invention facilitate a planar antenna having dual polarization with high bandwidth and with a tapered amplitude distribution which leads to low side lobe levels.

EXAMPLE EMBODIMENTS

Example 1 includes an antenna, comprising: a first set of two subarrays, where each subarray of the first set of two subarrays comprises: a first set of antenna elements; a first set of shunt waveguides, where each shunt waveguide of the first set of shunt waveguides is coupled to a unique subset of the first set of antenna elements; and a first series waveguide coupled to each shunt waveguide of the first set of shunt waveguides; a second set of two subarrays, where each subarray of the second set of two subarrays comprises: a second set of antenna elements; a second set of shunt waveguides, where each shunt waveguide of the second set of shunt waveguides is coupled to a unique subset of the second set of antenna elements; and a second series waveguide coupled to each shunt waveguide of the second set of shunt waveguides; wherein all of the series waveguides are substantially parallel; wherein each subarray of the first set of subarrays is interleaved with a unique subarray of the second set of subarrays so as to form first interleaved subarrays and second interleaved subarrays; wherein the first interleaved subarrays and the second interleaved subarrays are adjacent; and wherein the second series waveguides, of the first interleaved subarrays and the second interleaved subarrays, are disposed within the first series waveguides, of the first interleaved subarrays and the second interleaved subarrays.

Example 2 includes the antenna of Example 1, wherein each of the first series waveguides is coupled to a first power divider; wherein each of the second series waveguides are coupled to a second power divider; and wherein the first power divider is disposed over the second power divider.

Example 3 includes the antenna of Example 2, wherein each of the first power divider and the second power divider are formed from H-plane rectangular waveguide.

Example 4 includes the antenna of any of Examples 1-3, wherein at least one end of each shunt waveguide is terminated by a short displaced by a quarter guide wavelength from the nearest antenna element; and wherein at least one end of each series waveguide is terminated by a short displaced by a half guide wavelength from the nearest series slot.

Example 5 includes the antenna of any of Examples 1-4, wherein the first set of antenna elements is configured to at least one of: transmit a first electromagnetic signal having a first polarization state and receive a second electromagnetic signal having the first polarization state; and wherein the second set of antenna elements is configured to at least one of: transmit a third electromagnetic signal having a second polarization state and receive a fourth electromagnetic signal having the second polarization state.

Example 6 includes the antenna of Example 5, wherein the first polarization state and the second polarization state are orthogonal linear polarization states.

Example 7 includes the antenna of any of Examples 1-6, wherein each antenna element comprises a cavity and a radiating slot.

Example 8 includes the antenna of any of Examples 1-7, wherein an antenna element of the first set and an adjacent antenna element of the second set are separated by one quarter guide wavelength in each of two orthogonal axes.

Example 9 includes the antenna of Example 8, wherein the one quarter wavelength is substantially the one quarter guide wavelength of a shunt or series waveguide at the center frequency of an operating bandwidth for the corresponding antenna elements.

Example 10 includes the antenna of any of Examples 1-9, wherein each subarray, in an interleaved first subarray and second subarray, has a substantially equal number of antenna elements.

Example 11 includes the antenna of any of Examples 1-10, wherein each shunt waveguide and each series waveguide is formed from ridge waveguide.

Example 12 includes the antenna of Example 11, wherein the ridge waveguide has a first bifurcated broadwall and a second bifurcated broadwall opposite a broadwall; and wherein the antenna elements are coupled to a shunt waveguide by alternating slots in the first bifurcated broadwall and the second bifurcated broadwall.

Example 13 includes the antenna of any of Examples 1-12, wherein each antenna element is coupled to a shunt waveguide by a slot in the broadwall of the shunt waveguide.

Example 14 includes the antenna of any of Examples 1-13, wherein each shunt waveguide is coupled to a series waveguide by a Z-slot in broadwalls of the shunt waveguide and the series waveguide.

Example 15 includes a method, comprising: receiving first electromagnetic signals at a first set of antenna elements of each of two first subarrays of a planar antenna; receiving second electromagnetic signals at a second set of antenna elements of each of two second subarrays of a planar antenna, where each first subarray is interleaved with a unique second subarray creating a first interleaved subarray and a second interleaved subarray, and where first interleaved subarrays and second interleaved subarrays are adjacent; coupling the first electromagnetic signals from the first set of antenna elements of each first subarray to a first set of shunt waveguides of the corresponding first subarray; coupling the second electromagnetic signals from the second set of antenna elements of each second subarray to a second set of shunt waveguides of the corresponding second subarray; coupling the first electromagnetic signals from the first set of shunt waveguides of each first subarray to a first series waveguide of the corresponding first subarray; coupling the second electromagnetic signals from the second set of shunt waveguides of each second subarray to a second series waveguide of the corresponding second subarray, where: (a) all of the series waveguides are substantially parallel, and (b) the second series waveguides are disposed between the first series waveguides without any interceding series waveguides; combining the first electromagnetic signals received from first series waveguides of the two different subarrays; and combining the second electromagnetic signal received from second series waveguides of the two different subarrays.

Example 16 includes the method of Example 15, wherein the received first electromagnetic signals and the received second electromagnetic signal respectively have a first polarization and a second polarization.

Example 17 includes the method of any of Examples 15-16, wherein at least one of the first electromagnetic signal and the second electromagnetic signals are combined equally or unequally.

Example 18 includes a method, comprising: dividing a first electromagnetic signal between two first series waveguides, where each first series waveguide corresponds to a different subarray of a planar antenna; dividing a second electromagnetic signal between two second series waveguides, where each second series waveguide corresponds to a different subarray of the planar antenna, where: (a) all of the series waveguides are substantially parallel; and (b) the second series waveguides are disposed between the first series waveguides without any interceding series waveguides; distributing a divided first electromagnetic signal from each first series waveguide to a first set of shunt waveguides of a corresponding first subarray of two first subarrays; distributing a divided second electromagnetic signal from each second series waveguide to a second set of shunt waveguides of a corresponding second subarray of two second subarrays; coupling a distributed first electromagnetic signal from the first set of shunt waveguides to a first set of antenna elements of a corresponding first subarray of the two first subarrays, where a unique subset of the first set of the antenna elements is uniquely coupled to each shunt waveguide of the first set of shunt waveguides; coupling a distributed second electromagnetic signal from the second set of shunt waveguides to a second set of antenna elements of a corresponding second subarray of the two second subarrays, where a unique subset of the second set of the antenna elements is uniquely coupled to each shunt waveguide of the second set of shunt waveguides, where each first subarray is interleaved with a unique second subarray creating a first interleaved subarray and a second interleaved subarray, and where first interleaved subarrays and second interleaved subarrays are adjacent; emitting the first electromagnetic signal from the first antenna elements; and emitting the second electromagnetic signal from the second antenna elements.

Example 19 includes the method of Example 18, wherein at least one of the first electromagnetic signal and the second electromagnetic signals are divided equally or unequally.

Example 20 includes the method of Example 19, wherein the first electromagnetic signal and the second electromagnetic signal respectively have a first polarization and a second polarization.

Terms of relative position as used in this application are defined based on a plane parallel to, or in the case of the term coplanar—the same plane as, the conventional plane or working surface of a plate or waveguide, regardless of orientation. The term "horizontal" or "lateral" as used in this application are defined as a plane parallel to the conventional plane or working surface of a plate or waveguide, regardless of orientation. The term "vertical" refers to a direction perpendicular to the horizontal. Terms such as "on," "side" (as in "sidewall"), "higher," "lower," "over," "top," and "under" are defined with respect to the conventional plane or working surface being on the top surface of a plate or a waveguide, regardless of orientation. The term "coplanar" as used in this application is defined as a plane in the same plane as the conventional plane or working surface of a plane or waveguide, regardless of orientation.

While the present teachings have been illustrated with respect to one or more implementations, alterations and/or modifications can be made to the illustrated examples without departing from the scope of the appended claims. In addition, while a particular feature of the present disclosure may have been described with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. As used herein, the term "one or more of" with respect to a listing of items such as, for example, A and B or A and/or B, means A alone, B alone, or A and B. The term "at least one of" is used to mean one or more of the listed items can be selected.

The terms "about" or "substantially" indicate that the value or parameter specified may be somewhat altered, as long as the alteration does not result in nonconformance of the process or structure to the illustrated embodiment. Finally, "exemplary" indicates the description is used as an example, rather than implying that it is an ideal. Although specific embodiments have been illustrated and described herein, it will be appreciated by those of ordinary skill in the art that any arrangement, which is calculated to achieve the same purpose, may be substituted for the specific embodiments shown. Therefore, it is manifestly intended that this invention be limited only by the claims and the equivalents thereof.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. An antenna, comprising:

a first set of two subarrays, where each subarray of the first set of two subarrays comprises:

a first set of antenna elements;

a first set of shunt waveguides, where each shunt waveguide of the first set of shunt waveguides is coupled to a unique subset of the first set of antenna elements; and a first series waveguide coupled to each shunt waveguide of the first set of shunt waveguides;

a second set of two subarrays, where each subarray of the second set of two subarrays comprises:

a second set of antenna elements;

a second set of shunt waveguides, where each shunt waveguide of the second set of shunt waveguides is coupled to a unique subset of the second set of antenna elements; and a second series waveguide coupled to each shunt waveguide of the second set of shunt waveguides;

wherein all of the series waveguides are substantially parallel;

wherein each subarray of the first set of subarrays is interleaved with a unique subarray of the second set of subarrays so as to form first interleaved subarrays and second interleaved subarrays;

wherein the first interleaved subarrays and the second interleaved subarrays are adjacent; and wherein the second series waveguides, of the first interleaved subarrays and the second interleaved subarrays, are disposed within the first series waveguides, of the first interleaved subarrays and the second interleaved subarrays.

2. The antenna of claim 1, wherein each of the first series waveguides is coupled to a first power divider;

wherein each of the second series waveguides are coupled to a second power divider; and wherein the first power divider is disposed over the second power divider.

3. The antenna of claim 2, wherein each of the first power divider and the second power divider are formed from H-plane rectangular waveguide.

4. The antenna of claim 1, wherein at least one end of each shunt waveguide is terminated by a short displaced by a quarter guide wavelength from the nearest antenna element; and wherein at least one end of each series waveguide is terminated by a short displaced by a half guide wavelength from the nearest series slot.

5. The antenna of claim 1, wherein the first set of antenna elements is configured to at least one of: transmit a first electromagnetic signal having a first polarization state and receive a second electromagnetic signal having the first polarization state; and wherein the second set of antenna elements is configured to at least one of: transmit a third electromagnetic signal having a second polarization state and receive a fourth electromagnetic signal having the second polarization state.

6. The antenna of claim 5, wherein the first polarization state and the second polarization state are orthogonal linear polarization states.

7. The antenna of claim 1, wherein each antenna element comprises a cavity and a radiating slot.

8. The antenna of claim 1, wherein an antenna element of the first set and an adjacent antenna element of the second set are separated by one quarter guide wavelength in each of two orthogonal axes.

9. The antenna of claim 8, wherein the one quarter guide wavelength is substantially the one quarter guide wavelength of a series or shunt waveguide at the center frequency of an operating bandwidth for the corresponding antenna elements.

10. The antenna of claim 1, wherein each subarray, in an interleaved first subarray and second subarray, has a substantially equal number of antenna elements.

11. The antenna of claim 1, wherein each shunt waveguide and each series waveguide is formed from ridge waveguide.

12. The antenna of claim 11, wherein the ridge waveguide has a first bifurcated broadwall and a second bifurcated broadwall opposite a broadwall; and wherein the antenna elements are coupled to a shunt waveguide by alternating slots in the first bifurcated broadwall and the second bifurcated broadwall.

13. The antenna of claim 1, wherein each antenna element is coupled to a shunt waveguide by a slot in the broadwall of the shunt waveguide.

14. The antenna of claim 1, wherein each shunt waveguide is coupled to a series waveguide by a Z-slot in broadwalls of the shunt waveguide and the series waveguide.

15. A method, comprising:

receiving first electromagnetic signals at a first set of antenna elements of each of two first subarrays of a planar antenna;

receiving second electromagnetic signals at a second set of antenna elements of each of two second subarrays of a planar antenna, where each first subarray is interleaved with a unique second subarray creating a first interleaved subarray and a second interleaved subarray, and where first interleaved subarrays and second interleaved subarrays are adjacent;

coupling the first electromagnetic signals from the first set of antenna elements of each first subarray to a first set of shunt waveguides of the corresponding first subarray;

coupling the second electromagnetic signals from the second set of antenna elements of each second subarray to a second set of shunt waveguides of the corresponding second subarray;

coupling the first electromagnetic signals from the first set of shunt waveguides of each first subarray to a first series waveguide of the corresponding first subarray;

coupling the second electromagnetic signals from the second set of shunt waveguides of each second subarray to a second series waveguide of the corresponding second subarray, where:

(a) all of the series waveguides are substantially parallel, and (b) the second series waveguides are disposed between the first series waveguides without any interceding series waveguides;

combining the first electromagnetic signals received from first series waveguides of the two different subarrays; and combining the second electromagnetic signal received from second series waveguides of the two different subarrays.

16. The method of claim 15, wherein the received first electromagnetic signals and the received second electromagnetic signal respectively have a first polarization and a second polarization.

17. The method of claim 15, wherein at least one of the first electromagnetic signal and the second electromagnetic signals are combined equally or unequally.

18. A method, comprising:

dividing a first electromagnetic signal between two first series waveguides, where each first series waveguide corresponds to a different subarray of a planar antenna;

dividing a second electromagnetic signal between two second series waveguides, where each second series waveguide corresponds to a different subarray of the planar antenna, where:

(a) all of the series waveguides are substantially parallel; and (b) the second series waveguides are disposed between the first series waveguides without any interceding series waveguides;

distributing a divided first electromagnetic signal from each first series waveguide to a first set of shunt waveguides of a corresponding first subarray of two first subarrays;

distributing a divided second electromagnetic signal from each second series waveguide to a second set of shunt waveguides of a corresponding second subarray of two second subarrays;

coupling a distributed first electromagnetic signal from the first set of shunt waveguides to a first set of antenna elements of a corresponding first subarray of the two first subarrays, where a unique subset of the first set of the antenna elements is uniquely coupled to each shunt waveguide of the first set of shunt waveguides;

coupling a distributed second electromagnetic signal from the second set of shunt waveguides to a second set of antenna elements of a corresponding second subarray of the two second subarrays, where a unique subset of the second set of the antenna elements is uniquely coupled to each shunt waveguide of the second set of shunt waveguides, where each first subarray is interleaved with a unique second subarray creating a first interleaved subarray and a second interleaved subarray, and where first interleaved subarrays and second interleaved subarrays are adjacent;

emitting the first electromagnetic signal from the first antenna elements; and emitting the second electromagnetic signal from the second antenna elements.

19. The method of claim 18, wherein at least one of the first electromagnetic signal and the second electromagnetic signals are divided equally or unequally.

20. The method of claim 19, wherein the first electromagnetic signal and the second electromagnetic signal respectively have a first polarization and a second polarization.

* * * * *